US006226479B1

(12) United States Patent
Karaki et al.

(10) Patent No.: US 6,226,479 B1
(45) Date of Patent: May 1, 2001

(54) ELECTROPHOTOGRAPHIC PHOTOSENSITIVE MEMBER AND IMAGE FORMING APPARATUS

(75) Inventors: Tetsuya Karaki, Shizuoka-ken; Yuji Nakayama, Yokohama; Masaya Kawada; Takaaki Kaya, both of Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/391,047

(22) Filed: Sep. 16, 1999

(30) Foreign Application Priority Data

Sep. 17, 1998 (JP) ..... 10-263347

(51) Int. Cl.[7] ..... G03G 15/00
(52) U.S. Cl. ..... 399/159
(58) Field of Search ..... 399/159, 161, 399/176, 279, 286, 313, 343, 360, 356, 357; 430/56, 67; 492/27, 48

(56) References Cited

U.S. PATENT DOCUMENTS

| | | | | |
|---|---|---|---|---|
| 3,984,183 | * | 10/1976 | Maksymiak | 399/313 |
| 4,045,134 | | 8/1977 | Suzuki et al. | 399/159 |
| 5,459,558 | * | 10/1995 | Ishiyama | 399/176 |
| 5,667,926 | * | 9/1997 | Maruyama et al. | 399/343 |

OTHER PUBLICATIONS

Database WPI, Week 9805, Derwent Publ., AN 1998–048326, XP002124099 for JPA–09–297500.

Database WPI, Week 9633, Derwent Publ., AN 1996–325058, XP002124100 for JPA–08–146632.

Patent Abstracts of Japan, vol. 1995, No. 3, Apr. 1999, for JP6–337534.

Patent Abstracts of Japan, vol. 12, No. 74 (p–674), Mar. 1998, for JP 62–212663.

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

An electrophotographic amorphous silicon photosensitive member is used for an electrophotographic apparatus that forms images by the electrophotographic method, and an image forming apparatus uses this photosensitive member, which includes a drum-shaped cylindrical conductive substrate, and a photosensitive layer that contains amorphous silicon, thus structuring an electrophotographic photosensitive drum. Then, the outer diameter of this photosensitive drum is configured to be gradually smaller from the vicinity of the central portion thereof in the generatrix direction to both ends in the longitudinal direction, hence making it possible to enhance the cleaning effect on residual toner.

20 Claims, 7 Drawing Sheets

ELECTROPHOTOGRAPHIC PHOTOSENSITIVE MEMBER AND IMAGE FORMING APPARATUS

BACKGROUND OF THE INVENTION

1. Field of the Invention

The present invention relates to an electrophotographic photosensitive member provided with a photosensitive layer containing at least amorphous silicon (hereinafter referred to as a-Si) on a cylindrical conductive substrate, as well as to an image forming apparatus provided with the electrophotographic sensitive member, such as a copying machine, a printer, that forms images utilizing the electrophotographic process.

2. Related Background Art

A conventional image forming apparatus, such as a copying machine, a printer, a facsimile apparatus, utilizing the electrophotographic process, is arranged to form images by a charging process to charge the electrophotographic photosensitive drum (hereinafter referred to as a photosensitive drum) evenly and uniformly, which serves as an image bearing member in general; by a latent image forming process to write electrostatic latent images on the photosensitive drum; by a developing process to develop the electrostatic latent image with toner (developer); by a transfer process to transfer toner on the photosensitive drum to a transfer material; and by a fixing process to fix the toner on the transfer material.

Then, after the transfer process, the residual toner which remains on the photosensitive drum is removed by use of a cleaning device.

As the cleaning device that removes the residual toner remaining on the photosensitive drum after transfer, various ones have been proposed conventionally. For example, there is the cleaning device which scrapes off the residual toner remaining on the photosensitive drum after transfer by the cleaning blade formed by urethane rubber or some other elastic material, and which is widely in use because this device presents an excellent function of toner removal, while it can be structured compactly at lower costs.

However, it is conceivable that the particles, which adhere to the surface of the photosensitive drum to affect the image quality, are not only the toner, but also, the fine paper particles created from paper used for most of the transfer materials, the organic component extracted from the fine paper particles, and the corona product created due to the presence of the high-voltage member in the apparatus, among some others. If these particles as foreign substances should adhere to the surface of the photosensitive drum, it tends to impede the formation of clear electrostatic latent images, because these foreign substances present lower resistance condition under high humidity environment, thus inviting the degradation of image quality eventually.

It has been known that the a-Si photosensitive drum that forms film by the glow discharge decomposition of silane is easier to be affected by the above-mentioned phenomenon that may lead to the image degradation. In order to prevent the creation of such phenomenon of the image degradation, a method has been proposed to rub and remove the various foreign substances described above by the grinding function of toner particles in the location of the cleaning blade. The blade is spaced in such a manner that when the magnetic toner of monocomponent type is used as the developer in particular, the magnetic roller is arranged on the upstream side of the cleaning blade in a running direction (rotational direction) of the photosensitive drum so as to form the magnetic brush by use of a part of the toner (residual toner after transfer) collected by the cleaning blade. The magnetic brush thus formed is in contact with the surface of the photosensitive drum to supply the magnetic toner again.

As compared with the method involving rubbing the surface of the photosensitive drum by grinding element, such as a web, a rubber roller, which is separately prepared, the above-mentioned method has a lesser degree of the grinding function biased toward the surface of the photosensitive drum. Then, it may be possible to apply this method to the so-called Carlson photosensitive drum which enables charges to be transported in the photosensitive layer of the photosensitive drum at the time of exposure.

Therefore, this method produces a specific effect on the prevention of the image degradation resulting from the causes described above when it is used in combination with a method in which the surface of the photosensitive drum is prevented from presenting the lower resistance with the arrangement of a heater for the photosensitive drum, for example, so as to make humidity lower on the circumference of the drum at night or during standby.

In recent years, to address problems related to the environment or energy saving there is a growing demand that the power dissipation is reduced to a minimum at night or during standby. Also, under high humidity, the heater provided for the a-Si photosensitive drum should be energized. Otherwise, the foreign substances, such as corona product, which may adhere to the surface of the photosensitive drum, tend to promote a lower resistance on the surface of the photosensitive drum and invite the degradation of the image quality, such as running of images. For the reasons given below, it is conceivable that the intended rubbing removal of the lower resistive substance, such as discharge product, together with toner from the surface of the photosensitive drum is not completed exactly even by use of the cleaning device.

(1) The rubbing member in the cleaning device mainly rubs the photosensitive drum with the residual toner after transfer which exists between the rubbing member and the photosensitive drum. However, the residual toner after transfer may, in some cases, contain talc (whose chemical composition is: $Mg_3(Si_4O_{10})(OH)_2$) as a filler of the transfer material and other hygroscopic materials. As a result, it is conceivable that under high humidity, the surface resistance of the photosensitive drum is locally lowered to $10^{11}\Omega$ approximately to make it easier to create the running of images.

(2) There are some cases where the ratio of the external additives contained in toner becomes higher in the residual toner after transfer. Particularly when the external adhesives provide the polarity which is opposite to the charged polarity of the toner, this tendency is more conspicuous. Then, in this case, the ratio of the external additives becomes higher in the cleaning location to make the rubbing force smaller locally for the photosensitive drum. Conceivably, therefore, this phenomenon causes the resultant degradation of image quality.

(3) With the arrangement of the magnet roller on the upstream side of the cleaning blade for the formation of the magnetic brush with a part of the toner collected to the cleaning device, the magnetic toner is supplied again with such magnetic brush which is in contact with the surface of the photosensitive drum, then various foreign substances which have adhered to the surface of the photosensitive drum are removed by rubbing by the application of grinding forces using the toner particles in the blade position. In this case, it is conceivable that the grinding force by the toner particles is not effectuated uniformly in the longitudinal direction of the photosensitive drum.

Particularly, on both ends of the cleaning blade, the contact pressure of the cleaning blade becomes higher inevitably. Further, on both ends of the cleaning blade, toner is not supplied to the magnet roller sufficiently. The resultant coating amount of toner becomes smaller, and in some cases, the toner is not supplied to the cleaning blade sufficiently. Under such conditions, the cleaning blade vibrates on both ends thereof in particular, making it impossible to remove toner on the surface of the photosensitive drum completely which results in defective cleaning.

Here, not only the effect of grinding force on both ends of the cleaning blade is smaller, but also the surface layer of the photosensitive drum is ground unevenly by the cleaning blade in some cases.

SUMMARY OF THE INVENTION

It is an object of the present invention to provide a photosensitive drum and an image forming apparatus, which are capable of executing the uniform cleaning in the longitudinal direction, and also, capable of stably obtaining clear and high quality images even under a highly humid environment by preventing images from running, while providing a uniform grinding amount of the surface layer of the photosensitive drum.

In order to achieve this object, the present invention is designed to provide an electrophotographic amorphous silicon photosensitive member used for an electrophotographic apparatus that forms images by the electrophotographic method, and an image forming apparatus that uses this photosensitive member, and comprises a drum-shaped cylindrical conductive substrate, and a photosensitive layer that contains amorphous silicon and that is provided on the drum-shaped cylindrical conductive substrate, thus structuring an electro-photographic photosensitive drum. Then, the outer diameter of this photosensitive drum is configured to be gradually smaller from the vicinity of the central portion thereof in the generatrix direction to both ends in the longitudinal direction, hence making it possible to enhance the cleaning effect on residual toner.

DETAILED DESCRIPTION OF THE PREFERRED EMBODIMENTS

Hereinafter, with reference to the accompanying drawings, the embodiments in accordance with the present invention will be described.

(First Embodiment)

Figure 1:
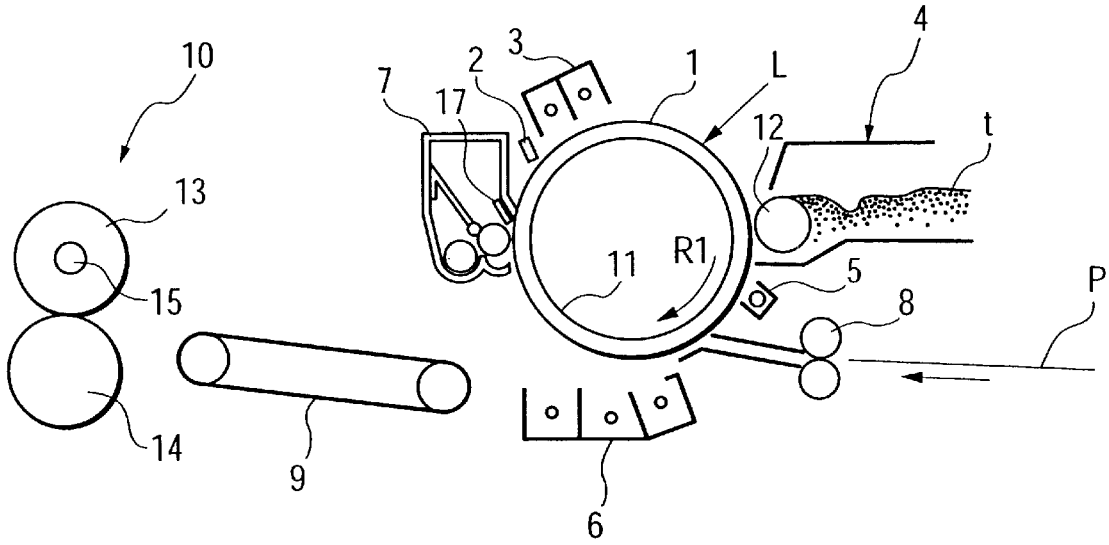
FIG. 1 is a structural view which schematically shows an image forming apparatus provided with a photosensitive drum in accordance with an embodiment of the present invention.

FIG. 1 is a structural view which schematically shows an image forming apparatus provided with a photosensitive drum in accordance with the present embodiment.

The image forming apparatus shown in FIG. 1 is provided with the photosensitive drum 1 as image bearing member to be driven to rotate in the direction indicated by an arrow R1. On the circumference of the photosensitive drum 1, there are provided a pre-exposure exposure device 2; a primary charger 3; a developing device 4; a post charger 5; a transfer and separation charger 6; and a cleaning device 7. Also, in the conveying direction of a transfer material P, such as a paper sheet, a registration roller 8, a conveying device 9, and a fixing device 10 are arranged from the upstream side in that order with the photosensitive drum 1 between them.

In accordance with the present embodiment, the photosensitive drum 1 is provided with the a-Si photosensitive layer in a thickness of approximately 30 $\mu$m on a cylindrical substrate formed by metal (aluminum, for example) in a thickness of approximately 5 mm, and the outer diameter thereof is formed in 108 mm. The photosensitive drum 1 is driven by driving means (not shown) at a specific speed in the direction indicated by the arrow R1. The surface of the photosensitive drum 1 is uniformly charged by a glow discharge of the primary charger 3. Also, in the interior of the photosensitive drum 1, a sheet heater 11 of approximately 80 W is arranged around it. The electric power is controlled so that the temperature of the drum substrate is kept at approximately 42° C.

Figure 2A:
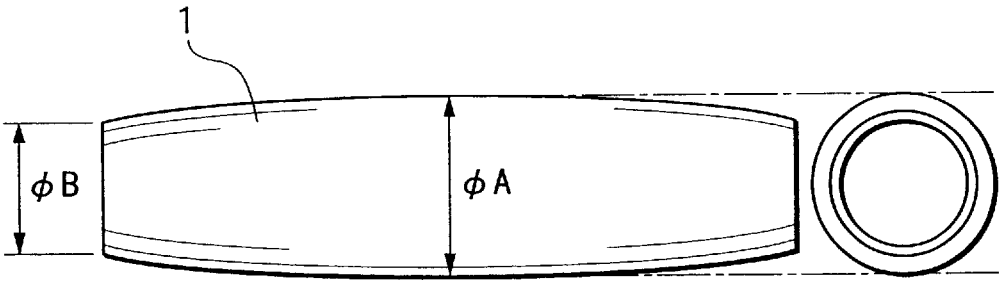
FIGS. 2A and 2B are views which illustrate the photosensitive drum of the image forming apparatus in accordance with the embodiment of the present invention.
Figure 2B:
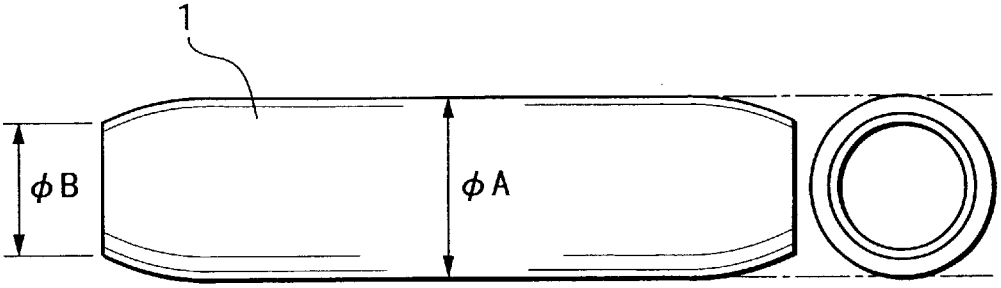

Also, in accordance with the present embodiment, the photosensitive drum 1 is configured in the inverted crown shape as shown in FIGS. 2A and 2B (the detailed structure of the photosensitive drum 1 will be described later).

The developing device 4 is provided with a developing sleeve 12 formed by a coating layer of the mixture of phenol resin, graphite, and carbon on the surface of aluminum cylinder of 20 mm diameter in the present embodiment, and then, the toner t which is the developer is contained in the developing device 4. The toner t is coated on the developing sleeve 12 by a magnetic blade (not shown). A gap of approximately 280 $\mu$m is set between the developing sleeve 12 and the magnetic blade (not shown).

As the toner t, the monocomponent magnetic toner whose glass-transition temperature is approximately 60° C. is used. The toner has an average particle diameter of approximately 9 $\mu$m and is negatively charged. Styrene acrylate is used as the main binder. The magnetic member is present at approximately 80 parts by weight. 4% strontium titanate and 0.5% silica are used as the external additives to the toner. The triboelectricity of the toner t is −3 to 12 ($\mu$C/g) on the developing sleeve 12, and the coating amount is 0.6 to 1.3 mg/cm$^2$.

The developing sleeve 12 is driven in the direction opposite to the rotational direction of the photosensitive drum 1 at a relative speed of 150%. The gap is set at approximately 230 μm between the developing sleeve 12 and the photosensitive drum 1. To the developing sleeve 12, the developing bias is applied from a high-voltage supply source (not shown) at the frequency of 2,700 Hz and the peak-to-peak voltage of 1,400 V with the superposition of the direct current and the rectangular waves of 35% duty ratio.

The cleaning device 7 is provided with the cleaning blade 17 to remove the residual toner after transfer which remains on the surface of the photosensitive drum 1 subsequent to the execution of the transfer.

The fixing device 10 is provided with the fixing roller 13 and the pressure roller 14. The fixing roller 13 and the pressure roller 14 are in pressure contact with each other. For the fixing roller 13, the fluoroplastic (PTFE) surface layer is coated by burning in a thickness of approximately 20 μm on the silicon rubber layer 0.25 mm thick. The pressure roller 14 is formed by the silicon rubber 60 mm diameter and 5 mm thick, which is covered by a fluoroplastic (PFA) tube 100 μm thick. Also, in the interior of the fixing roller 13, a halogen heater 15 rated at 1,600 W is arranged.

In this respect, a high-voltage supply source and others (not shown) are connected to the primary charger 3, the developing sleeve 12, and the transfer and separation charger 6. Also, each of the photosensitive drum 1, the developing sleeve 12, and the fixing roller 13 is provided with a driving motor (not shown), respectively, so as to enable each of them to be driven to rotate individually.

Now, the description will be made of the image forming operation of the image forming apparatus described above.

The photosensitive drum 1 is driven by driving means (not shown) to rotate in the direction indicated by the arrow R1 at a predetermined speed. After the residual charge of the surface thereof is eliminated by the pre-exposure device 2, the surface is uniformly charged by the primary charger 3. Then, the image exposure L is effectuated on the surface of the photosensitive drum 1 in accordance with image information inputted from the exposing device (not shown) so that the charges on the exposed portions are eliminated to form an electrostatic latent image. The electrostatic latent image is developed by the adhesion of toner by the developing sleeve 12 of the developing device 4, to which the developing bias has been applied accordingly, hence being visualized as toner images.

Then, when the toner image on the photosensitive drum 1 arrives at the transfer nip between the photosensitive drum 1 and the transfer and separation charger 6, the transfer material P, which has been conveyed by a conveying system (not shown), is fed by the registration roller 8 in sync with the timing. Thus, by the transfer and separation charger 6 to which the transfer bias is applied, the toner image on the photosensitive drum 1 is transferred to the surface of the transfer material P.

Then, the transfer material P, which has been separated from the photosensitive drum 1 by the function of the transfer and separation charger 6, is conveyed by the conveying device 9 to the gap between the fixing roller 13 and the pressure roller 14 of the fixing device 10. The transfer material P having the toner image thus transferred is discharged to the outside after the toner image is fixed by the pressure and heating between the fixing roller 13 heated by the halogen heater 15 and the pressure roller 14.

Subsequent to the transfer, the residual toner remaining on the photosensitive drum 1 is removed by the cleaning device 7.

Now, the description will be made of the operation of the clearing device 7 to remove the residual toner remaining on the photosensitive drum 1 after transfer.

Figure 3:
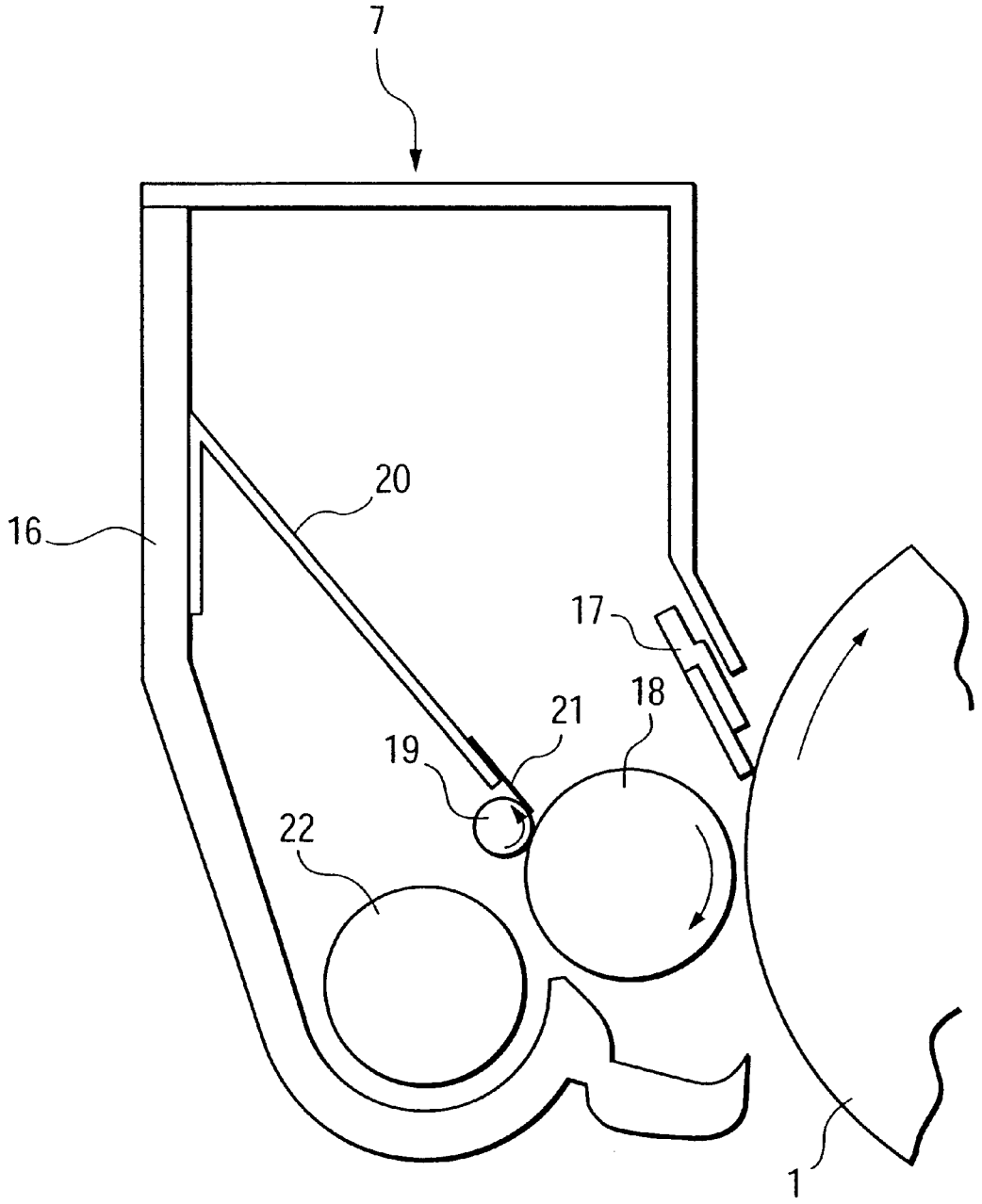
FIG. 3 is a cross-sectional view which shows the cleaning device of the image forming apparatus in accordance with the embodiment of the present invention.

In the cleaning container 16 of the cleaning device 7, the cleaning blade 17 is held to abut against the surface of the photosensitive drum 1 as shown in FIG. 3. On the upstream side (on the upstream side with respect to the rotational direction of the photosensitive drum 1) of the cleaning blade 17 in the cleaning container 16, the magnet roller 18 is provided to form a predetermined gap between the photosensitive drum 1 and the magnet roller 18 in the longitudinal direction of the photosensitive drum 1. The cleaning blade 17 is formed by urethane rubber of 2 mm in thickness, and the magnet roller 18 is structured by a roller of 18 mm in diameter which is provided with eight poles each having a magnetic-flux density of 500 gauss.

In the vicinity of the magnet roller 18 in the cleaning container 16, the toner layer thickness regulating roller 19 of a smaller diameter (8 mm in diameter), which regulates the thickness of the toner layer formed on the surface of the magnet roller 18, is arranged rotatably in parallel with the magnet roller 18. Then, the scraper 21 installed on the distal end of the stay 20, the other end of which is fixed to the cleaning container 16, is in contact with the surface of the toner layer thickness regulating roller 19. Also, on the bottom in the cleaning container 16, a conveying screw 22 is rotatably arranged in the longitudinal direction of the magnet roller 18.

The toner layer thickness regulating roller 19 is structured by non-magnetic material. On the surface of the toner layer thickness regulating roller 19, the fluoroplastic which is a substance having a smaller surface energy is coated in a thickness of approximately 10 to 50 μm. The magnet roller 18 is driven by driving means (not shown) to rotate in clockwise direction with respect to the photosensitive drum 1 at a speed slower than the rotation of the photosensitive drum 1. The toner layer thickness regulating roller 19 is driven to rotate in the direction (counterclockwise direction) opposite to that of the magnet roller 18 at a predetermined speed.

Figure 4:
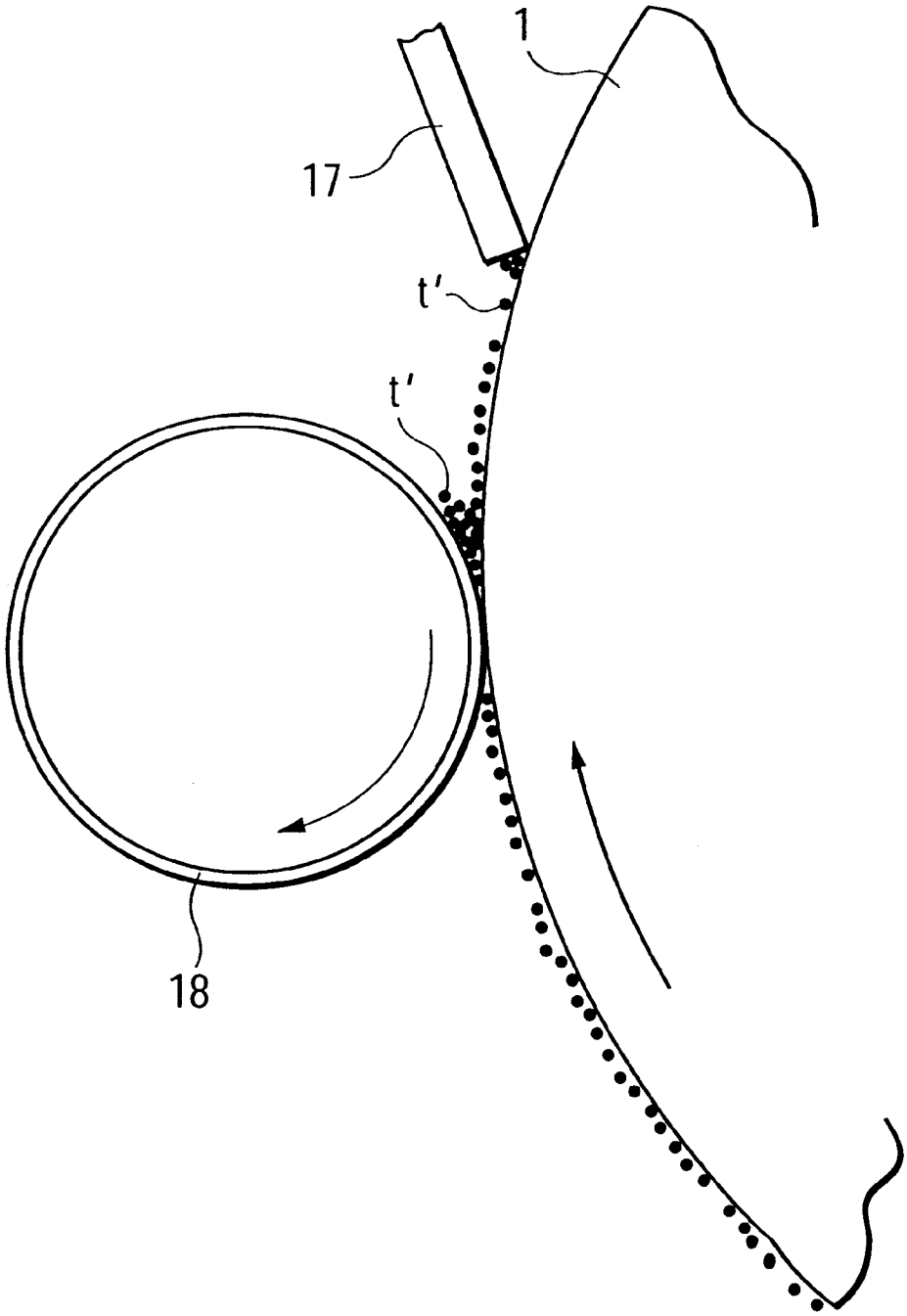
FIG. 4 is a cross-sectional view which shows the principal part of the cleaning device of the image forming apparatus in accordance with the embodiment of the present invention.

Then, as shown in FIG. 4, the residual toner t' after transfer which remains on the photosensitive drum 1 without being transferred to the transfer material P is scraped off from the photosensitive drum 1 by the cleaning blade 17 when the residual toner arrives at the position of the cleaning device 7 from the transfer nip (the position between the photosensitive drum 1 and the transfer and separation charger 6 ) along with the rotation of the photosensitive drum 1. The residual toner t' after transfer thus scraped off drops onto the magnet roller 18, and forms the toner gathering between the magnet roller 18 and the photosensitive drum 1.

Also, a part of the residual toner on the photosensitive drum 1 is adsorbed to the magnet roller 18 and conveyed to form the toner layer on the magnet roller 18. This toner layer is regulated to an even thickness by the toner layer thickness regulating roller 19. Then, the residual toner t' after transfer on the magnet roller 18 is caused to stand like the ears of rice to form a magnetic brush on the surface of the magnet roller 18. Thus, along with the rotation of the magnet roller 18, the brush reaches the location opposite to the photosensitive drum 1 one after another so as to operate the rub cleaning for the removal of various foreign substances adhering to the surface of the photosensitive drum 1. Here, the residual toner t' after transfer which has overflown from the toner layer thickness regulating roller 19 is conveyed by the conveying screw 22 in the depth direction of the interior of the cleaning container 16, hence being collected into a waste toner container (not shown).

Also, toner is coated evenly on the surface of the photosensitive drum 1 by the standing magnetic brush on the surface of the magnet roller 18. The toner thus coated evenly on the surface of the photosensitive drum 1 is either scraped off by the cleaning blade 17 or resides on the cleaning blade 17 to perform the rub cleaning for the photosensitive drum 1 together with the cleaning blade 17.

Now, the structure of the photosensitive drum 1 will be described.

The photosensitive drum 1 comprises a drum-shaped metallic substrate, and the photoconductive layer formed on the substrate, which contains an amorphous material having silicon atom as its matrix (preferably, an amorphous material containing at least either one of hydrogen atom and halogen atom as its component atom). Also, there is provided a barrier wall layer between the drum-shaped metallic substrate and the photo-conductive layer, and an upper layer as the surface charge blocking layer or the protection layer is arranged on the photoconductive layer.

The basic material used for the drum-shaped metallic substrate which is preferably adopted for the present invention is metal, such as NiCr, stainless steel, Al, Cr, Mo, Au, Nb, Ta, V, Ti, Pt, or Pd, or its alloy. Al and Al alloys are used preferably in particular. The reason why the Al and Al alloys are preferably used in particular for the drum-shaped metallic substrate is that it is comparatively easier to obtain the material having the exact circle and surface flatness and smoothness in good precision, and at the time of manufacture, it is easier to control the temperature on the deposition surface of the a-Si (H, X), and then, it is economical to use them.

As the halogen atom (X) which may be contained in the photoconductive layer of the photosensitive drum 1, it is possible to cite fluorine, chlorine, bromine, and iodine. Particularly, it is preferable to cite chlorine, and more preferably, fluorine. Also, as the components other than the silicon atom, hydrogen atom, and halogen atom which are contained in the photoconductive layer, the third atomic group atom (III group atom) such as boron, gallium, listed on the table of the periodic law, the fifth group atom (V group atom) such as nitrogen, phosphorus, arsenic, listed on the table of the periodic elements, or oxygen atom, carbon atom, germanium atom, or the like may be contained individually or in an appropriate combination as the component that may adjust the Fermi level, the width of forbidden band, or the like.

The barrier wall layer is arranged for the purpose to enhance the contactness between the photoconductive layer and the drum-shaped metallic substrate or to adjust the charge acceptance capacity. The barrier wall layer is structured as a monolayer or multiple layer with the a-Si (H, X) layer or polycrystal-Si layer containing the III group atom, V group atom, oxygen atom, carbon atom, germanium atom or the like depending on the intended purpose.

Also, on the upper part of the photoconductive layer, a layer may be arranged as the surface charge blocking layer or the protection layer, which is formed by the amorphous material preferably containing a large amount of carbon atom, nitrogen atom, oxygen atom, or the like with the silicon atom as its matrix, which may also contain hydrogen atom or halogen atom as required, or a layer which is formed by highly resistive organic substance may also be arranged.

As the method of forming the photoconductive layer structured by the a-Si (H, X), it is possible to adopt the vacuum deposition method that utilizes the conventionally known various electric discharge phenomena, such as the glow discharging method, the sputtering method, or the ion plating method, among some others.

Also, the outer diameter of the photosensitive drum 1 of the present invention is made gradually smaller from the central position of the photosensitive drum 1 to both ends thereof in the generatrix direction (longitudinal direction) as shown in FIGS. 2A and 2B. In other words, the shape of the photosensitive drum 1 is in the form of inverted crown. Then, given that the outer diameter of the central position of the photosensitive drum 1 in the generatrix direction is $\phi A$, and given that each of the outer diameters at both ends is $\phi B$, its shape is confined within the following range:

$$60\ \mu m \leqq \phi A - \phi B \leqq 100\ \mu m$$

Then, using an apparatus whose structure is the same as the image forming apparatus shown in FIG. 1 the evaluation is made as to the cleaning effect produced on the residual toner t' after transfer by the cleaning blade 17 of the inverted crown type photosensitive drum 1 of the present invention.

In the evaluation, a photosensitive drum of 108 mm in outer diameter, which is almost in the flat shape of $|\phi A - \phi B| \leqq 20\ \mu m$, is used as the conventional photosensitive drum, and an inverted crown type of 108 mm in outer diameter, which is in the shape of $|\phi A - \phi B| \leqq 80\ \mu m$ is used as the photosensitive drum of the present invention as shown in Table 1.

TABLE 1

| | Outer Diameter | Shape |
|---|---|---|
| Conventional Drum | $\phi$108 mm | Flat: $\lvert\phi A - \phi B\rvert \leqq 20\ \mu m$ |
| Drum of the Invention | $\phi$108 mm | Inverted Crown: $\lvert\phi A - \phi B\rvert \leqq 80\ \mu m$ |

$\phi A$: the outer diameter of the central position
$\phi B$: the outer diameter of each end Then, the print durability is set for 100,000 A4-sized sheets each in the case of the cleaning device 7 which is provided with the magnet roller 18 and the one which is provided only with the cleaning blade 17 but not with the magnet roller 18, and also, the evaluation is made as to the cleaning effect produced on the residual toner t' after transfer each with the solid white/half tone/solid black images, respectively. Here, the durability is set under the environments of constant temperature/humidity (30° C./60%). The results of the evaluation are shown on Table 2:

TABLE 2

| | With Magnet Roller | Without Magnet Roller |
|---|---|---|
| Conventional drum | B | C |
| Drum of the Invention | A | B |

A: Best B: Better C: Middle

As is apparent from the results of the evaluation, no cleaning defects are made when the inverted crown type photosensitive drum of the present invention is used. Also, it is possible to obtain a better cleaning result in the case where the cleaning blade 17 and the magnet roller 18 are provided for the cleaning device 7.

Figure 5A:
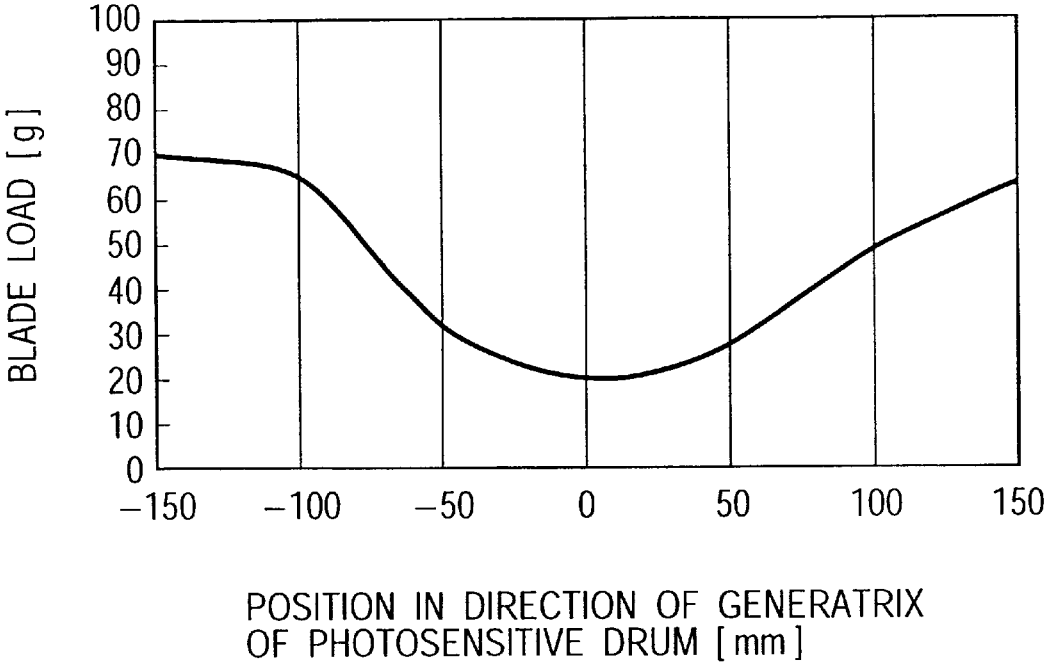
FIG. 5A is a view which shows the relationship between the positions of the photosensitive drum in the generatrix direction and the load distribution of the blade in accordance with the conventional art.
Figure 5B:
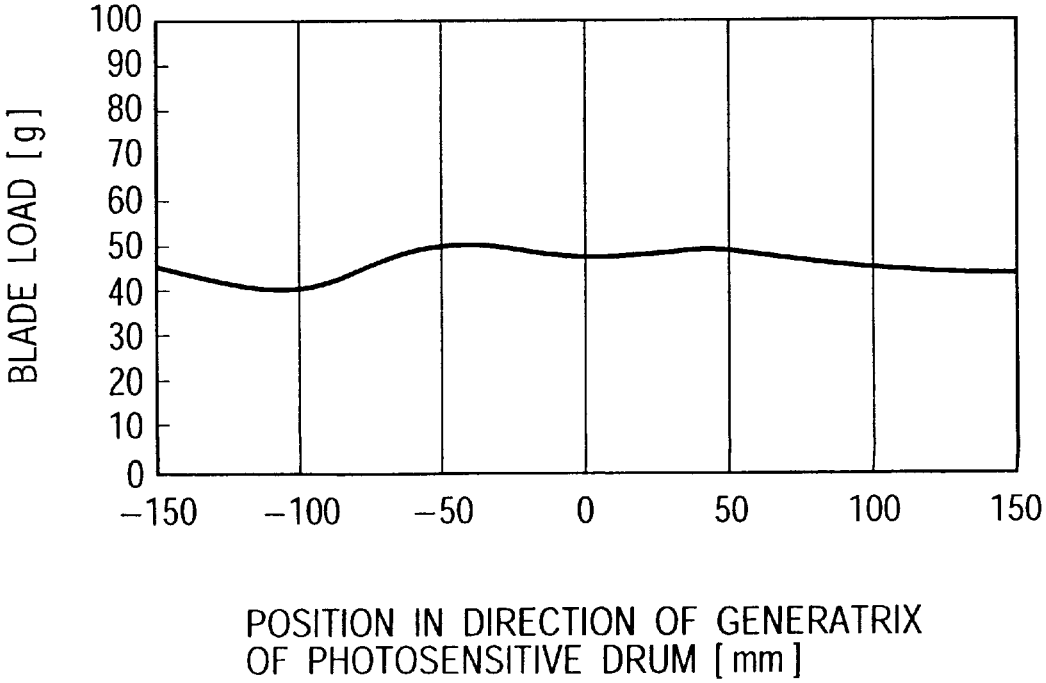
FIG. 5B is a view which shows the relationship between the positions of the photosensitive drum in the generatrix direction and the load distribution of the blade in accordance with the present invention.
Figure 6A:
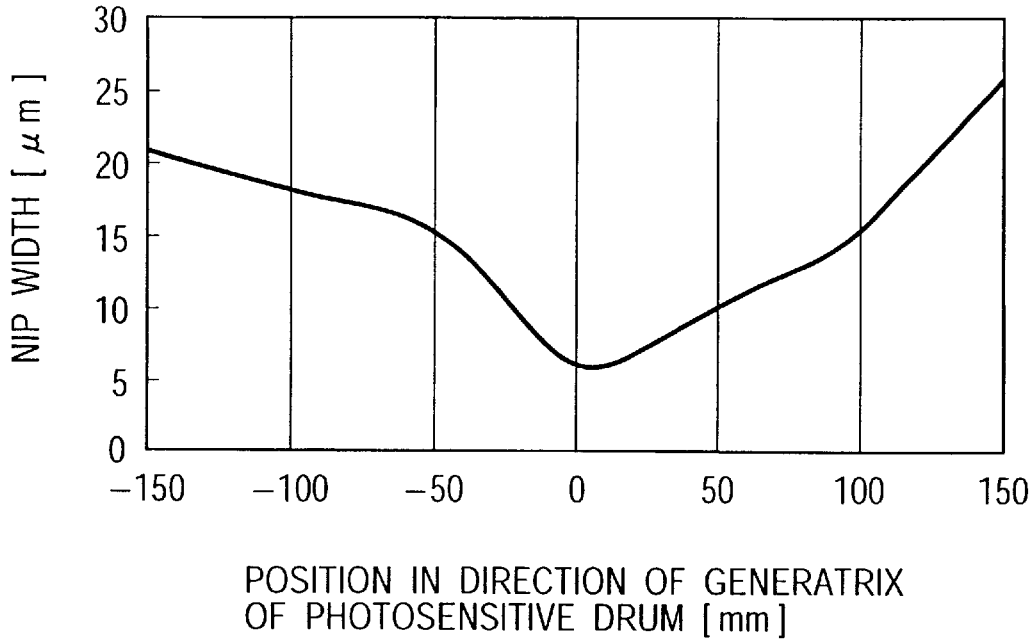
FIG. 6A is a view which shows the relationship between the positions of the photosensitive drum in the generatrix direction and the nip width in accordance with the conventional art.
Figure 6B:
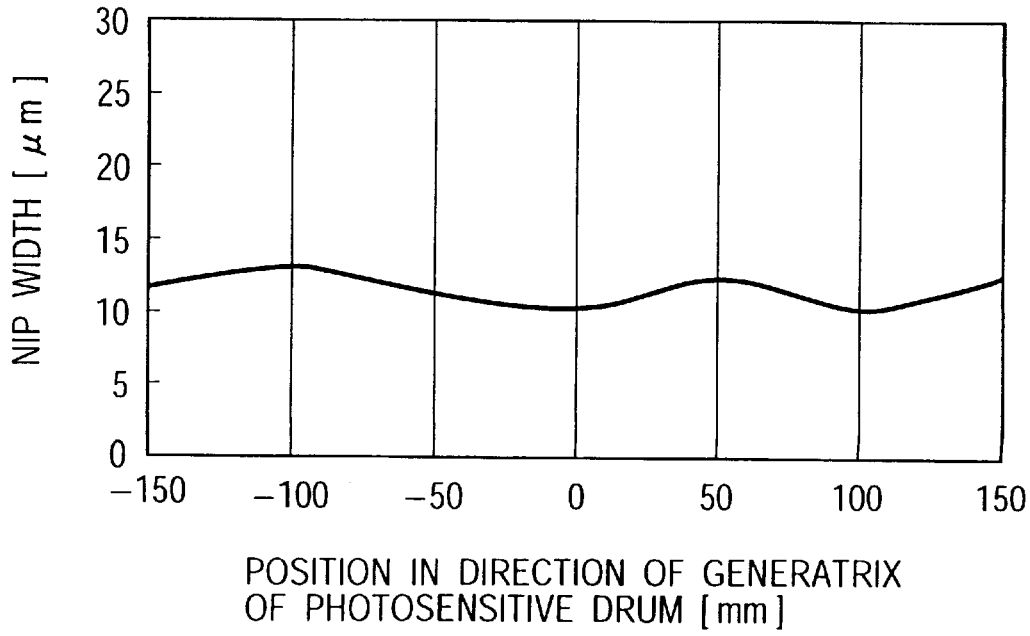
FIG. 6B is a view which shows the relationship between the positions of the photosensitive drum in the generatrix direction and the nip width in accordance with the present invention.

FIGS. 5A and 5B, and FIGS. 6A and 6B are views which represent the relationships between the blade loads of the cleaning blade 17 and the nip widths in the longitudinal direction of the photosensitive drum on evaluating cleaning effects of the cleaning blade 17 for the residual toner t' after transfer. FIG. 5A shows the blade loads of the conventional photosensitive drum. FIG. 5B shows the blade loads of the invention. FIG. 6A shows the nip widths of the conventional photosensitive drum, and FIG. 6B shows the nip widths of the invention.

As is apparent from these views, it is possible to make the blade loads and nip widths of the inverted crown type photosensitive drum of the present invention almost uniform in the generatrix direction (longitudinal direction) of the photosensitive drum. Thus, with the cleaning blade 17, the residual toner t' after transfer can be cleaned off in good condition.

Also, in the evaluation of the cleaning effect by the cleaning blade 17 produced on the residual toner t' after transfer, the durability is set under the environments of high temperature/humidity (30° C./80%). The results of the evaluation are shown in Table 3.

TABLE 3

| | | With magnet roller | without magnet roller |
|---|---|---|---|
| Conventional drum | Cleaning condition | B | C |
| | Image running | B | D to C |
| Drum of the Invention | Cleaning condition | A | B |
| | Image running | A | C to B |

A: Best B: Better C: Middle D: Worse

Even under such environments of the high temperature/humidity (30° C./80%), no cleaning defects are made in the case of the inverted crown type photosensitive drum of the present invention. Also, a better cleaning condition is obtained in the case where the cleaning blade 17 and the magnet roller 18 are provided for the cleaning device 7.

Also, as shown in Table 4, using the inverted crown type photosensitive drums (with outer diameter of 108 mm each having the ϕA (the outer diameter in the central position of the photosensitive drum 1 in the generatrix direction)−the ϕB (the outer diameter at each of both ends) is 20 to 200 μm), respectively, the print durability is set for 100,000 A4-sized sheets, and then, the evaluation is made on the cleaning condition of the residual toner t' after transfer by the cleaning blade 17, the deflection widths of the blade loads of each photosensitive drums ((the maximum−the minimum)/the mean value), as well as on the uneven image densities of the half tone images. Here, the durability is set under the environments of constant temperature/humidity (30° C./60%). The Table 5 shows the results of the evaluation at that time.

TABLE 4

| | Drum A | Drum B | Drum C | Drum D | Drum E |
|---|---|---|---|---|---|
| ϕA-ϕB [μm] | 20 | 50 | 60 | 80 | 90 |
| | Drum F | Drum G | Drum H | Drum I | |
| ϕA-ϕB [μm] | 100 | 120 | 150 | 200 | |

TABLE 5

| | | Cleaning condition | Blade load distribution | Image density unevenness |
|---|---|---|---|---|
| Drum A | 20 | B | B | A |
| Drum B | 50 | B | B | A |
| Drum C | 60 | A | A | A |
| Drum D | 80 | A | A | A |
| Drum E | 90 | A | A | A |
| Drum F | 100 | A | A | A |
| Drum G | 120 | B | B | B |
| Drum H | 150 | B | B | B |
| Drum I | 200 | B | B | B |

A: Best B: Better

As is apparent from the results of the evaluation, it is possible to obtain good results on the evaluation on the cleaning conditions, the deflection widths of blade loads (blade load distribution), and uneven image densities of all the shapes of the inverted crown type photosensitive drums of the present invention, each having the ϕA−ϕB of 20 to 200 μm, respectively. Particularly, with the shapes each having the ϕA−ϕB of 60 to 100 μm, respectively, it becomes possible to obtain better evaluations on the cleaning conditions, the deflection widths of blade loads (blade load distribution), and uneven image densities.

In accordance with the results of the evaluation, it is arranged to form the inverted crown type of the photosensitive drum 1 so that the ϕA (the outer diameter of the photosensitive drum 1 in the central position in the generatrix direction)−ϕB (the outer diameter of each end) becomes 60 to 100 μm for the present invention.

Also, the evaluation is made on the cleaning conditions by use of the photosensitive drum of the organic photosensitive member (OPC photosensitive member) of 108 mm in outer diameter as a comparative example used for the present invention. Then, during the durability observation, the surface of the photosensitive drum is ground and scratched. As a result, it becomes impossible to obtain good results.

Figure 7A:
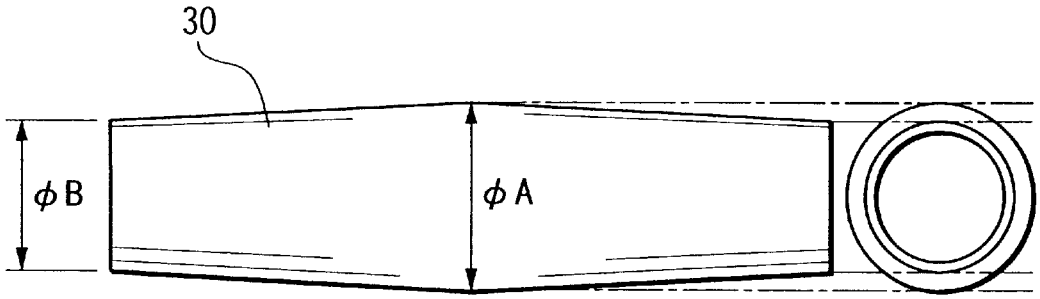
FIGS. 7A and 7B are views which illustrate the photosensitive drums of the comparative examples used for the present invention, respectively.
Figure 7B:
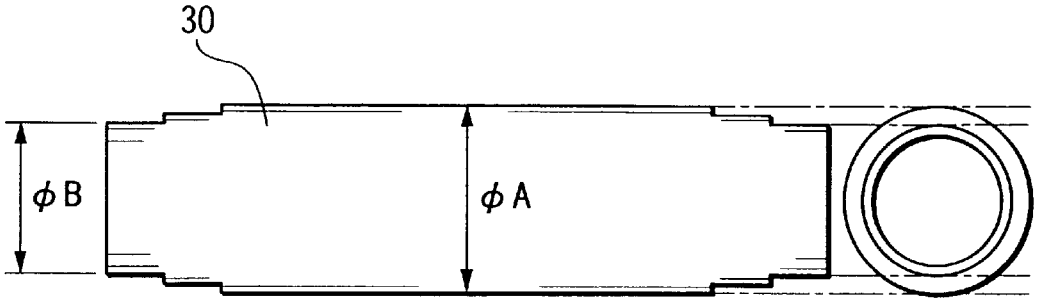

Further, as other photosensitive drums used for comparison with the present invention, the inverted crown type photosensitive drums 30 shown in FIGS. 7A and 7B, the evaluation is made on the cleaning conditions as described above. The photosensitive drum 30 shown in FIG. 7A is configured in the inverted crown shape, the ϕA (the outer diameter of the photosensitive drum 30 in the central position in the generatrix direction)−ϕB (the outer diameter on each end) of which is 200 μm or more. The photosensitive drum 30 shown in FIG. 7B is configured in the inverted crown shape having stepped portions in the generatrix direction (longitudinal direction) thereof.

With these photosensitive drums 30, the cleaning conditions are evaluated. However, cleaning defects have ensued.

As described above, in accordance with the present invention, the shape of the photosensitive drum having the a-Si photosensitive layer is formed so that the outer diameter of the photosensitive drum is made gradually smaller in the longitudinal direction from the vicinity of the central position to the both ends, respectively. In this manner, the nip widths of the cleaning blade which should abut against the photosensitive drum are uniformalized, and then, the abutting load of the cleaning blade becomes even accordingly. As a result, it becomes possible for the cleaning blade to effectuate the uniform cleaning in the longitudinal direction so as to obtain clear and high quality images stably by preventing the images from running or the like even under a high humid environment, as well as to attain making the grinding amount of the a-Si photosensitive layer of the photosensitive drum even.

What is claimed is:

1. An electrophotographic photosensitive member used for an electrophotographic apparatus for forming images by an electrophotographic process, comprising:

a drum-shaped cylindrical conductive substrate;

a photosensitive layer containing amorphous silicon arranged on said substrate, wherein said electrophotographic photosensitive member is formed as an electrophotographic photosensitive drum, and an outer diameter of said photosensitive drum is made gradually smaller from a vicinity of a central position in a generatrix direction to both ends in a longitudinal direction, wherein the outer diameter in the center position of said photosensitive drum is $\phi A$ ($\mu$m) and the outer diameter of each end as $\phi B$ ($\mu$m), and wherein $\phi A$ and $\phi B$ satisfy a relationship of 60 $\mu m \leqq \phi A - \phi B \leqq 100$ $\mu$m.

2. An electrophotographic photosensitive member used for an electrophotographic apparatus for forming images by an electrophotographic process, comprising:

a drum-shaped cylindrical conductive substrate;

a photosensitive layer containing amorphous silicon arranged on said substrate, wherein said electrophotographic photosensitive member is formed as an electrophotographic photosensitive drum, and an outer diameter of the substrate of said photosensitive drum is made gradually smaller from a vicinity of a central position in a generatrix direction to both ends in a longitudinal direction, wherein the outer diameter in the central position of said substrate is $\phi A$ ($\mu$m), and the outer diameter of each end is $\phi B$ ($\mu$m) and $\phi A$ and $\phi B$ satisfy a relationship of 60 $\mu m \leqq \phi A - \phi B \leqq 100$ $\mu$m.

3. An image forming apparatus for forming images by an electrophotographic process comprising:

an electrophotographic photosensitive drum having a drum-shaped cylindrical conductive substrate and a photosensitive layer arranged on said substrates, said photosensitive layer containing amorphous silicon, an outer diameter of said photosensitive drum being made gradually smaller from a vicinity of a central position in a generatrix direction to each end in a longitudinal direction;

means for forming a toner image on said photosensitive drum; and transfer means for transferring a formed toner image to a transfer material, wherein the outer diameter in the central position of said photosensitive drum is $\phi A$ ($\mu$m), and the outer diameter of each end is $\phi B$ ($\mu$m) and wherein $\phi A$ and $\phi B$ satisfy a relationship of 60 $\mu m \leqq \phi A - \phi B \leqq 100$ $\mu$m.

4. An image forming apparatus according to claim 3, wherein said image forming apparatus further comprises cleaning means provided with a cleaning blade to rub and remove from a surface of the photosensitive drum a residual toner remaining on the surface of said photosensitive drum after transfer.

5. An image forming apparatus according to claim 4, wherein toner used for forming said toner image is magnetic toner.

6. An image forming apparatus according to claim 5, wherein said cleaning means uses a magnet roller rotatably arranged in a vicinity of the surface of said electrophotographic photosensitive drum or arranged to abut against the surface of said electrophotographic photosensitive drum.

7. An image forming apparatus according to claim 6, wherein in said cleaning means, the magnet roller is arranged on an upstream side in a rotational direction of said photosensitive drum, and the cleaning blade is arranged on a downstream side.

8. An image forming apparatus for forming an image by an electrophotographic process comprising:

an electrophotographic photosensitive drum having a drum-shaped cylindrical conductive substrate and a photosensitive layer arranged on said substrate, said photosensitive layer containing amorphous silicon, an outer diameter of said conductive substrate being made gradually smaller from a vicinity of a central position in a generatrix direction to each end in a longitudinal direction;

means for forming a toner image on said photosensitive drum; and transfer means for transferring a formed toner image to a transfer material, wherein the outer diameter in the central position of said conductive substrate of the photosensitive drum is $\phi A$ ($\mu$m), and the outer diameter of each end is $\phi B$ ($\mu$m), and wherein $\phi A$ and $\phi B$ satisfy a relationship of 60 $\mu m \leqq \phi A - \phi B \leqq 100$ $\mu$m.

9. An image forming apparatus for forming an image by an electrophotographic process comprising:

an electrophotographic photosensitive drum having a drum-shaped cylindrical conductive substrate and a photosensitive layer arranged on said substrate, said photosensitive layer containing amorphous silicon, an outer diameter of said conductive substrate being made gradually smaller from a vicinity of a central position in a generatrix direction to each end in a longitudinal direction;

a developing device for forming a magnetic toner image on the photosensitive drum;

a transfer device for transferring a formed toner image to a transfer material; and a cleaning device provided with a magnet roller rotatably arranged in a vicinity of a surface of said photosensitive drum or arranged to abut against the surface of said photosensitive drum to rub and remove a residual toner remaining on the surface of said photosensitive drum after transfer, and provided with a cleaning blade to rub said photosensitive drum, wherein the outer diameter in the central position of said photosensitive drum is $\phi A$ ($\mu$m), and the outer diameter of each end is $\phi B$ ($\mu$m) and wherein $\phi A$ and $\phi B$ satisfy a relationship of 60 $\mu m \leqq \phi A - \phi B \leqq 100$ $\mu$m.

10. An electrophotographic photosensitive drum comprising:

a drum-shaped substrate; and a photosensitive layer containing an amorphous silicon arranged on said substrate, wherein an outer diameter of said electrophotographic photosensitive drum is made gradually smaller from a vicinity of a central position to both ends in a generatrix direction of said electrophotographic photosensitive drum, and wherein the outer diameter in the central position is $\Phi A$ ($\mu$m), and the outer diameter of said both ends is $\Phi B$ ($\mu$m) and $\Phi A$ and $\Phi B$ satisfy a relationship of 20 $\mu m < \Phi A - \Phi B < 200$ $\mu$m.

11. An electrophotographic photosensitive drum according to claim 10, wherein a relationship of 60 $\mu m \leqq \Phi A - \Phi B \leqq 100$ $\mu$m is satisfied.

12. An electrophotographic photosensitive drum according to claim 10, including cleaning means contacting a surface of said electrophotographic photosensitive drum to clean residual toner remaining on said electrophotographic photosensitive drum.

13. An electrophotographic photosensitive drum according to claim 12, wherein said cleaning means has a cleaning blade which is in contact with the surface of said electrophotographic photosensitive drum.

14. An electrophotographic photosensitive drum according to claim 13, wherein said cleaning means has a magnet roller which forms thereon a magnetic brush adapted to rub said electrophotographic photosensitive drum.

15. An electrophotographic photosensitive drum according to claim 14, wherein said electrophotographic photosensitive drum bears a toner image and said magnetic brush comprises a toner of said toner image.

16. An electrophotographic apparatus comprising:

an electrophotographic photosensitive drum which has a drum-shaped substrate and a photosensitive layer containing an amorphous silicon arranged on said substrate;

image forming means for forming a toner image on said electrophotographic photosensitive drum; and cleaning means being in contact with a surface of said electrophotographic photosensitive drum for cleaning off residual toner remaining on said electrophotographic photosensitive drum, wherein an outer diameter of said electrophotographic photosensitive drum is made gradually smaller from a vicinity of a certain position to both ends in a generatrix direction of said electrophotographic photosensitive drum, and wherein the outer diameter in the central position is $\Phi A$ ($\mu$m), and the outer diameter of both ends is $\Phi B$ ($\mu$m) and $\Phi A$ and $\Phi B$ satisfy a relationship of $20\ \mu m < \Phi A - \Phi B < 200\ \mu m$.

17. An electrophotographic apparatus according to claim 16, wherein a relationship of $60\ \mu m < \Phi A - \Phi B < 100\ \mu m$ is satisfied.

18. An electrophotographic apparatus according to claim 17, wherein said cleaning means has a cleaning blade which is in contact with the surface of said electrophotographic photosensitive drum.

19. An electrophotographic apparatus according to claim 18, wherein said cleaning means has a magnet roller which forms thereon a magnetic brush, said magnetic brush adapted to rub said electrophotographic photosensitive drum.

20. An electrophotographic apparatus according to claim 19, wherein said magnetic brush is formed from a toner of said toner image.

* * * * *

UNITED STATES PATENT AND TRADEMARK OFFICE

CERTIFICATE OF CORRECTION

PATENT NO. : 6,226,479 B1
DATED : May 1, 2001
INVENTOR(S) : Tetsuya Karaki et al.

It is certified that error appears in the above-identified patent and that said Letters Patent is hereby corrected as shown below:

Column 2,
Line 7, "by" should read -- by a --; and
Line 52, "the" (first occurrence) should read -- a --.

Column 5,
Line 20, "by the" should read -- of --; and "mm" should read -- mm in --.

Column 6,
Line 65, "drum, then" should read -- drum. Then, the --.

Column 7,
Line 41, "atom" should be deleted; and
Line 42, "fifth" should read -- fifth atomic --.

Column 11,
Line 14, "as" should read -- is --; and
Line 37, "substrates," should read -- substrate, --.

Signed and Sealed this

Twelfth Day of March, 2002

*Attest:*

*Attesting Officer*

JAMES E. ROGAN
*Director of the United States Patent and Trademark Office*